US005286174A

United States Patent [19]

Fujiwara et al.

[11] Patent Number: 5,286,174

[45] Date of Patent: Feb. 15, 1994

[54] FLUID COMPRESSION DEVICE

[75] Inventors: Takayoshi Fujiwara, Kawasaki; Toshikatsu Iida, Yokohama; Takashi Honjo, Tokyo; Masayuki Okuda, Yokohama, all of Japan

[73] Assignee: Kabushiki Kaisha Toshiba, Kawasaki, Japan

[21] Appl. No.: 15,791

[22] Filed: Feb. 10, 1993

[30] Foreign Application Priority Data

Feb. 10, 1992 [JP] Japan ..... 4-023975
Aug. 28, 1992 [JP] Japan ..... 4-229890

[51] Int. Cl.[5] ..... F04C 18/16

[52] U.S. Cl. ..... 417/356; 418/220; 418/183

[58] Field of Search ..... 417/356; 418/220, 183, 418/164, 172

[56] References Cited

U.S. PATENT DOCUMENTS

| | | | |
|---|---|---|---|
| 4,521,169 | 6/1985 | Ogawa | 418/164 |
| 4,527,968 | 7/1985 | Ogawa | 418/164 |
| 4,871,304 | 10/1989 | Iida et al. | 418/304 |
| 4,872,820 | 10/1989 | Iida et al. | 418/220 |
| 4,875,842 | 10/1989 | Iida et al. | 418/220 |
| 5,028,222 | 7/1991 | Iida | 418/220 |
| 5,062,778 | 11/1991 | Hattori et al. | 418/220 |
| 5,090,874 | 2/1992 | Aikawa | 418/220 |
| 5,125,805 | 6/1992 | Fujiwara | 418/220 |
| 5,139,394 | 8/1992 | Aikawa et al. | 418/220 |
| 5,141,423 | 8/1992 | Aikawa et al. | 418/220 |
| 5,184,940 | 2/1993 | Fujiwara | 418/220 |

FOREIGN PATENT DOCUMENTS

| | | | |
|---|---|---|---|
| 4-63990 | 2/1992 | Japan | 418/220 |

*Primary Examiner*—Richard A. Bertsch
*Assistant Examiner*—Peter Korytnyk
*Attorney, Agent, or Firm*—Cushman, Darby & Cushman

[57] ABSTRACT

A fluid compressor including a sealed case having an oil bank in which oil is held, a cylinder arranged in the sealed case, a rotation body eccentrically arranged in the cylinder, a main shaft and a sub-shaft formed at each of axial end portions of the rotation body, a spiral groove formed on a periphery thereof such that a pitch of the spiral groove gradually decreases from the sub-shaft side to the main shaft side, a spiral blade engaged with the groove such as to be able to project therefrom or retreat therein, a main bearing and a sub-bearing for eccentrically supporting the cylinder and the rotation body, and a suction hole provided in the rotation body for allowing an operation fluid having a low pressure before compression to flow from the main shaft side to the sub-shaft side so as to introduce the fluid into an inner space of the cylinder, the cylinder and the rotation body rotated relatively with each other so as to transport the operation fluid from the sub-shaft side to the main shaft side for compression.

9 Claims, 3 Drawing Sheets

FLUID COMPRESSION DEVICE

BACKGROUND OF THE INVENTION

1. Field of the Invention

The present invention relates to a fluid compressor, more specifically to a type for compressing a refrigerant gas in a refrigerating cycle.

2. Description of the Related Art

USP Nos. 4,871,304, 4,872,820, and 5,082,222, for example, disclose fluid compressors of a type in which the refrigerant gas of the refrigerating cycle is compressed while conveying the gas in the axial direction of the cylinder.

There is also another type of fluid compressor as shown in FIG. 7. In a general compressor, refrigerant gas is taken into the device from a main bearing 1 side, and compressed toward a sub-bearing 2 side. However, in a fluid compressor of this type, a thrust force works on a rotation rod 3 due to pressure difference of the refrigerant gas. In order to balance the thrust force, a pressure introduction hole 4 is formed in the rotation rod 3. Refrigerant gas at a suction pressure is introduced into an internal cavity 5 of the sub-bearing 2, and an end face of a sub-axis 6 of the rotation rod 3 is pressurized. The diameters of the sections of the rotation rod 3 are determined such as to cancel out thrust forces for balance.

The diameter of the main body of the rotation rod 3 is set to be larger than that of a main shaft 9. The main shaft 9 is inserted into an internal cavity 10 of the main bearing 1. A part of the end surface 11 of the main body 8 and a part of the end face 12 of the main bearing 1 face closely with each other. A suction hole 13 is formed in the main bearing 1, and serves to connect a suction tube 15 associated with a sealed case 14, and an inner space of a cylinder 16 with each other. The refrigerant gas passes through the suction hole 13, and is introduced to the operation chamber formed in the cylinder 16.

FIG. 7 also depicts a discharge tube 17, which is connected to the sealed case 14 to be associated with the inner space thereof.

In a fluid compressor of the above-described type, a refrigerant gas is used to balance thrust forces. Consequently, the diameter of each of the main shaft 9 and the sub-shaft 6 of the piston must be determined such as to have a sufficiently large cross section area. However, as the diameter of the main shaft 9 increases, the thickness of the main bearing 1 decreases.

In order for the cylinder 16 to take a sufficient amount of the refrigerant gas therein, the suction hole 13 should have a large passage area. However, if the diameter of the suction hole 13 is simply set large, the opening of the suction hole 13 is partially covered by the end face 11 of the main body 8, and therefore the amount of the gas taken in the cylinder does not increase.

In consideration of the above, in order to have a sufficiently larger passage area, there should be provided a plurality of suction holes 13 as shown in FIG. 8A, or the suction hole 13 should be made into a deformed elliptic shape as in FIG. 8B, thereby increasing the production cost of the main bearing.

Further, the pressure introduction hole 4 and the suction hole 13 must be separately provided, and the pressure introduction hole 4 is the main factor of increasing the production cost.

SUMMARY OF THE INVENTION

The purpose of the invention is to provide a fluid compressor in which there is no need to provide a suction hole in its main bearing, and therefore processing of parts is simple.

In order to achieve the above purpose, there is provided, according to the present invention, a fluid compressor comprising: a sealed case having an oil bank in which oil is held; a cylinder arranged in the sealed case; a rotation body eccentrically arranged in the cylinder; a main shaft and a sub-shaft formed at each of axial end portions of the rotation body; a spiral groove formed on a periphery thereof such that a pitch of the spiral groove gradually decreases from the sub-shaft side to the main shaft side; a spiral blade engaged with the groove such as to be able to project therefrom or retreat therein; a main bearing and a sub-bearing for eccentrically supporting the cylinder and the rotation body; and a suction hole provided in the rotation body for allowing an operation fluid having a low pressure before compression to flow from the main shaft side to the sub-shaft side so as to introduce the fluid into an inner space of the cylinder;

the cylinder and the rotation body rotated relatively with each other so as to transport the operation fluid from the sub-shaft side to the main shaft side for compression.

According to the present invention, there is no need to form a suction hole in the main bearing, and therefore process of parts of the fluid compressor can be simplified.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

Figure 5A:
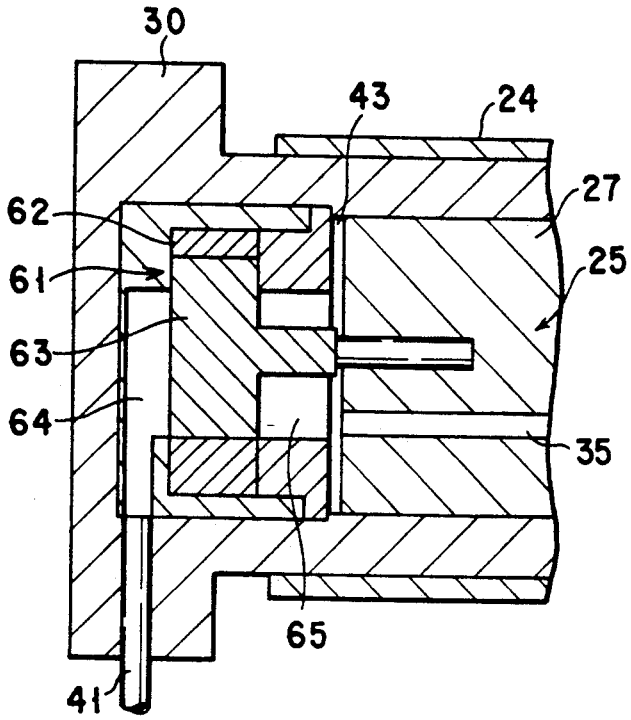
Figure 5B:
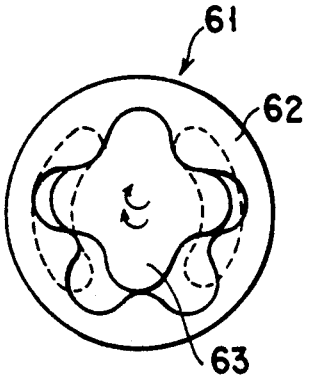
Figure 6:
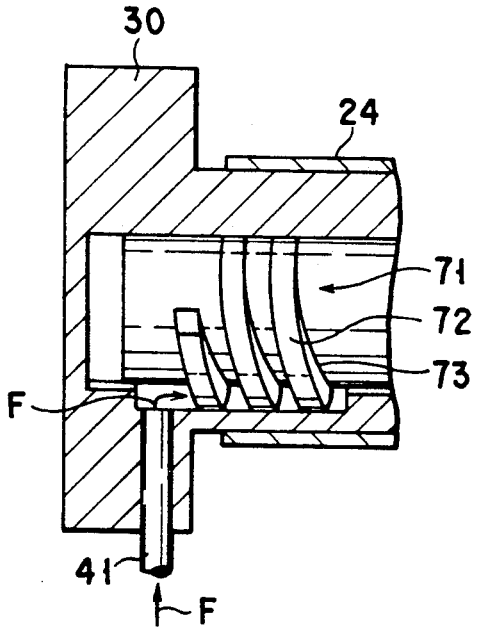
Figure 7:
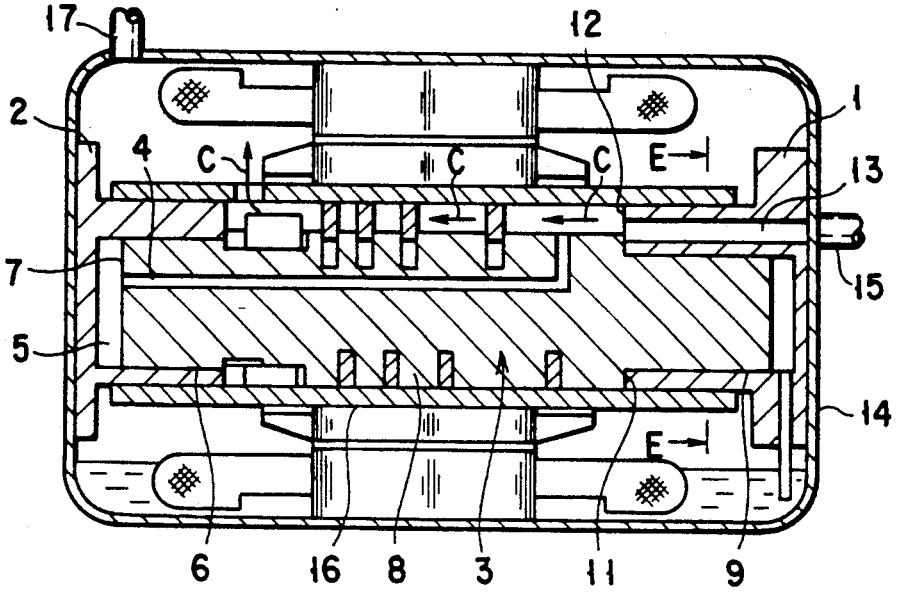
(RELATED ART) FIG. 7

Each of FIGS. 5A and 5B is a diagram showing a trochoid-type oil feeding pump;

FIG. 6 is a spiral blade type oil feeding pump;

FIG. 7 is a cross section of a conventional compressor; and

Figure 8A:
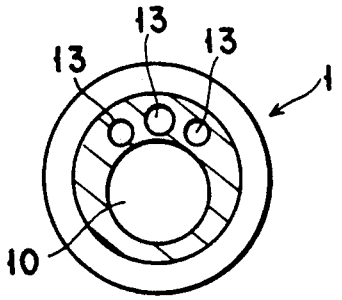
(RELATED ART) FIG. 8A
Figure 8B:
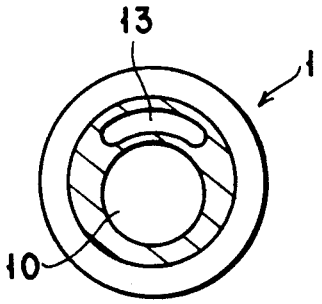
(RELATED ART) FIG. 8B

FIGS. 8A and 8B are cross sections of conventional main bearings.

DETAILED DESCRIPTION OF THE PREFERRED EMBODIMENTS

An embodiment of the present invention will now be described with reference to accompanying drawings.

Figure 1:
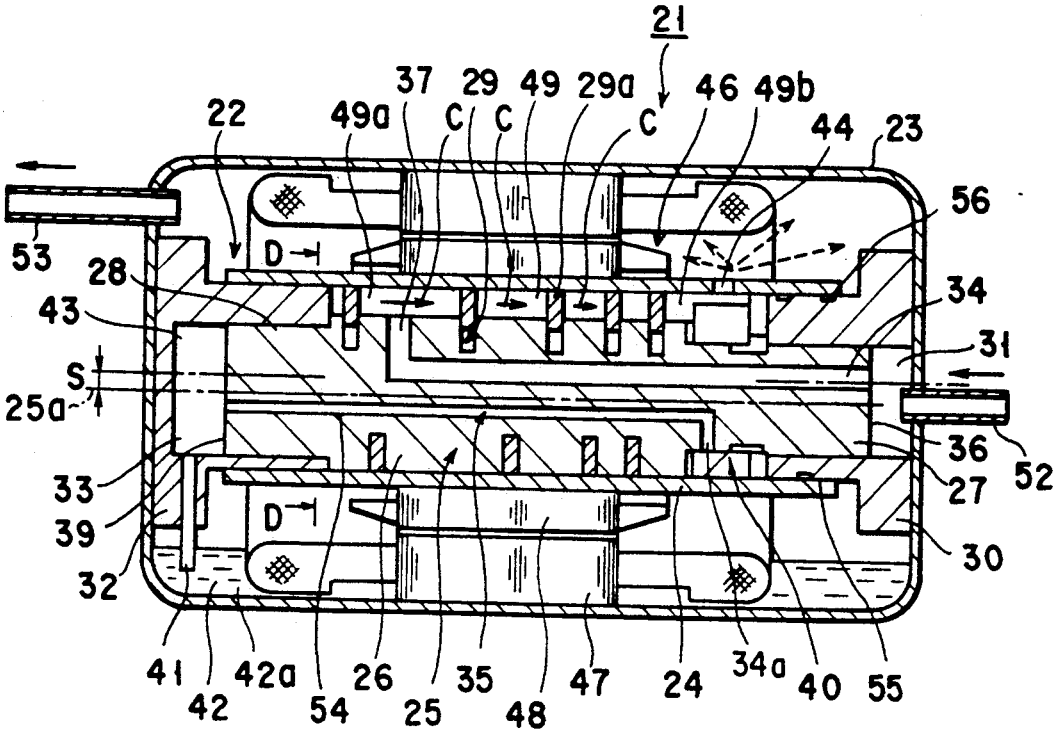
FIG. 1 is a cross section of a compressor according to an embodiment of the present invention.

FIG. 1 shows an embodiment of the present invention, depicting a fluid compressor 21, and a compression mechanism section 22 of the compressor 21. The compression mechanism portion 22 is housed in a sealed case 23 along with a motor 46. The compression mechanism portion 22 includes a cylinder 24 having both axial ends opened, and a rotation rod 25 serving as a rotation body eccentrically arranged in the cylinder 24.

The rotation rod 25 consists of a main body 26, and a main shaft 27 and a sub-shaft 28 each having a diameter smaller than that of the main body 26. On the periphery of the main body 26, there is formed a spiral groove 29, with which a spiral blade 29*a* is engaged.

The blade 29*a* is set such as to be able to project from or retreat in the groove 29 in the radial direction of the main body 26. The outer surface of the blade 29*a* is brought into contact with the inner surface of the cylinder 24 such as to break up the space defined between the cylinder 24 and the rotation rod 25 into a number of operation chambers 49. The pitch of the groove 29 is set such as to decrease gradually from an end of the main body 26 to the other end (from the left hand side to the right hand side in the figure), and therefore the volume of the operation chambers 49 formed in the cylinder 24 gradually decreases.

A main bearing 30 is fixed in the sealed case 23. The main bearing 30 is made into a step-cylindrical shape, and inserted into an end of the cylinder 24. The main bearing 30 has an inner cavity 31 made therethrough in the axial direction, in which the main shaft 27 of the rotation rod 25 is inserted. The outer surface of the main shaft 27 is brought into contact with the inner surface of the main bearing 30.

A sub-bearing 32 is inserted to the other end of the cylinder 24, and the sub-shaft 28 of the rotation rod 25 is inserted to the inner cavity of the sub-bearing 32. The inner cavity 33 of the sub-bearing 32 has a bottom, and one end of the inner cavity 33 is closed. The outer surface of the sub-shaft 28 is brought into contact with the inner surface of the sub-bearing 32.

A suction hole 34 and an oil feeding hole 35, each having a circular cross section, are formed in the rotation rod 25. The suction hole 34 runs from the main shaft 27 to the end portion of the sub-shaft 28 side of the main body 26, in substantially parallel with the axial center 25*a* of the rotation rod 25. The end portion of the sub-shaft 28 side of the suction hole 34 is bent at substantially right angle, and extends in the radial direction of the rotation rod 25.

One end of the suction hole 34 is opened as an inlet to the end face 36 of the main shaft 27. The other end of the suction hole 34 is opened to the outer surface at the sub-shaft side of the rotation rod 25.

This open end (outlet 34*a*) faces to a rotation force propagation mechanism 40 (described after).

Figure 2:
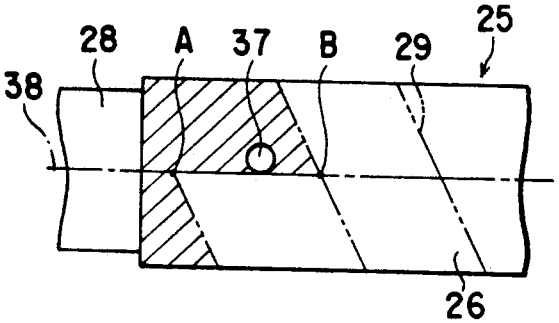
FIG. 2 is an explanatory view of the opening of a suction hole for position.
Figure 3:
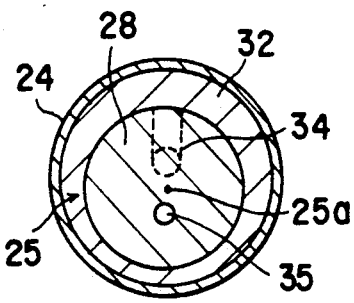
FIG. 3 is a cross section of a main portion taken along the line D—D shown in FIG. 1.

The position of the opening 37 of the suction hole 34 in the sub-shaft 28 side of the rotation rod 25 is determined as shown in FIG. 2. The position of the opening 37 is not strictly set to a particular section of the cylinder as long as it is located in a low-pressure section thereof, but should preferably be at a position where the suction hole 34 has the shortest depth, which can be easily processed. More specifically, the suction hole 34 is located at a position close to a line 38 connecting an origin A of the groove 29 and a point B where the phase of the groove 29 is 360°, and on the main shaft 27 side.

The oil feeding hole 35 runs from the sub-shaft 28 to the main shaft 27 in substantially parallel with the axial center 25*a* of the rotation rod 25. The end of the main shaft 27 side of the oil feeding hole 35 is bent at substantially right angle and extends in the radial direction of the rotation rod 25. The oil feeding hole 35 is opened to the end face 39 of the sub-shaft 28, and also to the border section between the main body 26 and the main shaft 27.

The suction hole 34 and the oil feeding hole 35 are formed symmetrical with respect to the axial center 25*a* of the rotation rod 25. The sections of both holes 34 and 35 extending in their radial directions are formed to face in directions opposite from each other.

The rotation force propagating mechanism 40, which utilizes an Oldham mechanism, is provided in the cylinder 24. The mechanism 40 is located at the border section between the main body 26 and the mainshaft 27, and serves to connect the rotation rod 25 loosely to the cylinder 24.

Figure 4:
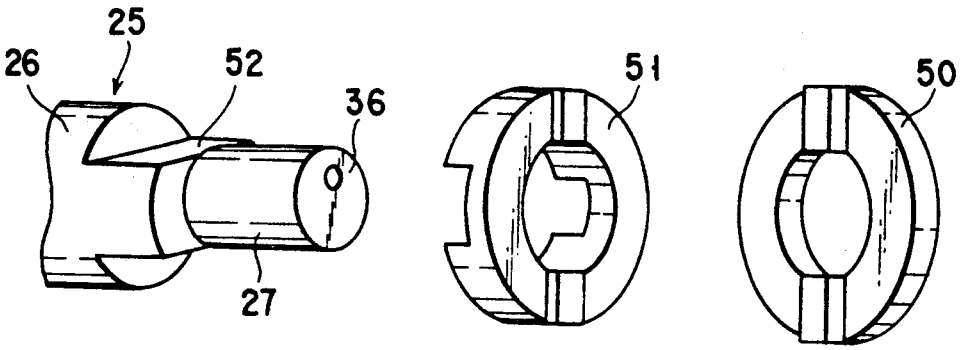
FIG. 4 is a development of a rotation force propagation mechanism.

As shown in FIG. 4, the rotation force propagating mechanism 40 comprises a fixed ring 50, a movable ring 51, and a rotation body Oldham section 52. The rotation body Oldham section 52 is formed integrally with the rotation rod 25. The outer diameter of the fixed ring 50 is set such as to be substantially the same as the inner diameter of the cylinder 24, and the outer diameter of the movable ring 51 is set such as to be smaller than that of the fixed ring 50.

The movable ring 51 is engaged with the rotation body Oldham section 52. The fixed ring 50 is fixed to the cylinder 24, and the movable ring 51 is engaged with the fixed ring 50. With this structure, the movable ring 51 can slide in the two directions normally crossing with each other as being engaged with the rotation body Oldham section 52 and the fixed ring 51.

An oil suction tube 41 is connected to the sub-bearing 32. The oil suction tube 41 is inserted in the sub-bearing 32 in the radial direction. The lower end of the oil suction tube 41 reaches the oil 42 held in the oil bank 42*a* of the sealed case 23, and the upper end of the tube is opened to the inner cavity 33 of the sub-bearing 32.

Inside the sub-bearing 32, there is provided an oil feeding space 43 utilizing the inner cavity 33, and the oil feeding space 43 is defined by the inner surface of the sub-bearing 32 and the end face 39 of the sub-shaft 28. The oil feeding space 43 is connected to the inner space of the sealed case 23 via the oil suction tube 41.

The cylinder 24 has a discharge hole 44. This discharge hole 44 is located at the end of the discharge side (the right hand side in FIG. 1) of the cylinder 24, and is opened to the rotational force propagating mechanism 40 and the motor 46.

A suction tube 52 and a discharge tube 53 are connected to the sealed case 23. The suction tube 52 is located on an imaginary extended line from the axial center 25*a* of the rotation rod 25, and projects into the inner cavity 31 of the main bearing 30.

The discharge tube 53 is located on the other side of the sealed case 23, from where the suction tube 52 is located, i.e. the sub-bearing 32 side. The discharge tube 53 is located outside the outer surface of the sub-bearing 32.

The motor 46 comprising a stator 47 and a rotor 48. The stator 47 is fixed to the case 23, and the rotor 48 is located on an inner side from the stator 47, and fixed to the cylinder 24. The motor 46 is interposed between the discharge hole 44 and the discharge tube 53.

The operation of the above-described fluid compressor 21 will now be described.

The compression mechanism 22 is driven by the motor 46 to rotate the cylinder 24, and the rotation force of the cylinder 24 is propagated to the rotation rod 25 via the rotation force propagation mechanism 40, so as to make the cylinder 24 and the rotation rod 25 rotate relatively with each other. The rotation angle of the rotation rod 25 is set such as to accord with that of the cylinder 24 by the rotation force propagation mechanism 40 The rotation rod 25 and the cylinder 24 are allowed to change the relative position therebetween by the rotation force propagation mechanism 40.

As the cylinder 24 and the rotation rod 25 rotates relatively with each other, for example, refrigerant gas in the refrigerating cycle is absorbed into the inner cavity 31 of the main bearing 30 via the suction tube 52. The refrigerant gas is introduced to the sub-shaft 28 side through the suction hole 34, and flows out to the inner space of the cylinder 24, i.e. a suction chamber 49*a*, from the opening 37. The suction chamber 49*a* is located at the endmost one having the lowest pressure, of the operation chambers 49.

The refrigerant gas flown out of the opening 37 is compressed while being gradually transported to the discharge side, i.e. the main shaft 27 side, as indicated by arrows C in FIG. 1. The compressed gas is transported from the discharge chamber 49 through the discharge hole 44, and discharged into the sealed case 23. The discharge chamber 49*b* is located at the endmost one having the highest pressure, of the operation chambers 49.

The refrigerant gas discharged into the case 23 once fills the inner space of the case 23, and then is introduced to an external device via the discharge tube 53.

The oil 42 held in the sealed case 23 is pressurized by the refrigerant gas in the case 23, and a portion of it travels up the suction tube 41. The portion of the oil 42 is absorbed up once in the feeding space 43 in the sub-bearing 32, and then flows into the feeding hole 35. The portion of the oil 42 passes through the oil feeding hole 35 and reaches the main shaft 27 side. Further, the portion flows out of the rotation rod 25, and is supplied to the rotation force propagation mechanism 40 and the slide sections of other members.

Of the structural members of the compressor 21, those which slide with each other are as follows:

The combinations of the blade 29*a* and the rotation rod 25, the blade 29*a* and the cylinder 24, the cylinder 24 and each of the bearings 30 and 32, the main shaft 27 of the rotation rod 25, and the sub-shaft 28 and the sub-bearing 32. In the rotation force propagation mechanism 40, the members slide with each other.

The portion of oil introduced in the discharge chamber 49*b* is discharged from the discharge hole 44 of the cylinder 24 along with high-pressure refrigerant gas. Since the refrigerant gas is highly pressurized, the oil is atomized and dispersed in the inner space of the case 23.

A portion of the atomized oil collides with the inner wall of the case 23 and the outer surface of the main bearing 30. Other portion of the atomized oil collide with the stator 47 of the motor 46, the rotor 48 itself, winding lines for these, etc. After the oil ejected from the discharge hole 44 of the cylinder 24 collide with the members therearound, the oil eventually returns to the oil bank 42*a* as in the original state.

FIG. 1 also depicts an oil feeding passage 54, through which the oil 42 flows. The feeding passage 54 comprises an oil suction tube 41, an oil feeding space 43, an oil feeding hole 35, a discharge chamber 49*b*, and discharge hole 44.

Of the inner and outer portions of the main bearing 30, and those of the sub-bearing 32, the outer portion 55 of the main bearing 30 is not affected by a pressure difference, an oil groove 56 should be provided such as to be integrated with the outer portion 55, for introduction of the oil 42. The oil introduced in the oil groove 56 flows along the groove as the cylinder 24 rotates, and lubricates the inner surface of the cylinder 24 with the outer portion 55 of the main bearing 30.

In the above-described fluid compressor 21, a suction hole 34 is provided in the rotation rod 25 such that refrigerant gas is introduced in the cylinder 24 via the rotation rod 25. Consequently, it is no need to make a suction hole in the main bearing 30, simplifying process of the main bearing 30. The number of suction holes, or the shape of each one are free from the relationship between the rotation rod 25 and the main bearing 30 in diameter size.

Further, the flow amount of the refrigerant gas can be determined only by the size of the suction hole 34 of the rotation rod 25, and therefore there should be only one suction hole 34. Consequently, process of the suction hole 34 is carried out.

Thus, the process cost for each of the rotation rod 25 and the main bearing 30 can be kept low.

Unlike the conventional type fluid compressor (for example, U.S. Pat. No. 5,028,222), the refrigerant gas is once introduced in the inner cavity 31 of the main bearing 30, and therefore the low-pressure refrigerant gas acts on the end face 36 of the main shaft 27. Consequently, there is no need to provide a pressure introduction hole, reducing the number of holes. Thus, the process cost is reduced.

Further, the suction hole 34 and the oil feeding hole 35 are symmetrically arranged at positions opposite to each other with respect to the axial center 25*a* of the rotation rod 25. Thus, the rotation rod 25 can be easily balanced, suppressing vibration of the rotation rod 25.

The rotation force propagation mechanism 40 is located at the border section between the main body 26 of the rotation rod 25 and the main shaft 27, and a portion of the oil 42 is introduced to the main shaft 27 side. With this structure, oil 42 can be directly supplied to the rotation force propagation mechanism 40, carrying out sufficient lubrication thereof.

A discharge hole 44 is located at one end of the cylinder 24, and a discharge tube 53 is located close to the sub-bearing 32. A motor 46 is interposed between the discharge hoe 44 and the discharge tube 53, which are arranged by a great distance from each other. Consequently, atomized oil ejected from the discharge hole 44 hardly reaches the discharge tube 53, thereby reducing the amount of oil flowing out of the case 23 from the discharge tube 53, and assuring sufficient lubrication of the sliding members.

A portion of the oil ejected from the discharge hole 44 serves to cool the motor 46, improving the driving efficiency of the compressor.

In the case where the pressure of the refrigerant gas is not utilized for feeding oil, or the pressure is too low, a compulsive oil feeding pump such as shown in FIGS. 5A–6 should be provided in the sub-shaft 28 for sufficient oil feeding.

FIGS. 5A and 5B show a trochoid-type oil feeding pump 61, which operates on the principle of a general trochoid-type pump. The pump 61 comprises an outer gear 62 and an inner gear 63, and the inner gear 63 rotates along with the rotation rod 25. As both gears relatively rotate with each other, oil is absorbed into the oil suction tube 41, transported from the suction port 64 through the discharge port 65, and introduced into the oil feeding hole 35 of the rotation rod 25.

FIG. 6 shows a spiral type oil feeding pump 71. The pump 71 comprises a spiral blade 72, and is fit into the spiral groove 73 formed in the sub-shaft 28. The pitch of the groove 73 is constantly set. As the rotation rod 25 rotates, oil is absorbed into the oil suction tube 41, and forcibly transported by the blade 72 in the direction indicated by the arrow F.

Lastly, the present invention is not limited to the above-described embodiment, and can be modified into a variety of versions as long as they do not fall out of the range of the present invention.

What is claimed is:

1. A fluid compressor comprising:

a sealed case having an oil bank in which oil is held;

a cylinder arranged in said sealed case;

a rotation rod, having a main body portion with a spiral groove therein and having a suction hole therethrough, eccentrically arranged in said cylinder;

a main shaft formed at one of the axial end portions of said rotation rod, and a sub-shaft formed at the other end thereof; decreasing from said sub-shaft side to said main shaft side;

a spiral blade engaged with said groove such as to be able to project therefrom or retreat therein;

a main bearing and a sub-bearing for eccentrically supporting said cylinder and said rotation rod, an inner surface of the main bearing and an end face of the main shaft defining an inner cavity located at the main shaft side of the rotation rod; and a suction tube, connected to the inner cavity, for allowing a low pressure operation fluid to flow through a wall of the sealed case and into the inner cavity, said suction hole provided in said rotation rod and connected to the inner cavity allowing the low pressure operation fluid to flow from the inner cavity at the main shaft side to said sub-shaft side so as to introduce said fluid into an inner space of said cylinder;

said cylinder and said rotation rod being rotatable with respect to each other so as to compress said operation fluid as the operation fluid is transported from said sub-shaft to said main shaft side;

wherein a thrust force acting on the rotation rod resulting from the compression of the operation fluid is at least partially balanced by an opposing thrust force on the rotation rod resulting from the low pressure operation fluid in the inner cavity acting on the end face of the main shaft side of the rotation rod.

2. A fluid compressor according to claim 1, wherein said rotation rod includes an oil feeding hole serving to send said oil from said sub-shaft side to said main shaft side.

3. A fluid compressor according to claim 2, wherein said suction hole and said oil feeding hole are arranged symmetrically with respect to an axial center of said rotation rod.

4. A fluid compressor according to claim 2, wherein a discharge tube is connected to said sealed case, and said cylinder has a discharge hole at one end thereof, said discharge tube arranged at a position close to an other end of said cylinder, and said discharge tube and said discharge hole being distant from each other.

5. A fluid compressor according to claim 2, further comprising a rotation force propagation mechanism arranged such that an outlet of said oil feeding hole faces thereto.

6. A fluid compressor according to claim 6, wherein said rotation force propagation mechanism is of an Oldham type.

7. A fluid compressor according to claim 2, further comprising an oil feeding pump for compulsively transporting said oil to said oil feeding hole.

8. A fluid compressor according to claim 7, wherein said oil feeding pump is of a trochoid type.

9. A fluid compressor according to claim 7, wherein said oil feeding pump is of a spiral blade type.

* * * * *